US010780704B2

(12) United States Patent
O'Reilly et al.

(10) Patent No.: US 10,780,704 B2
(45) Date of Patent: Sep. 22, 2020

(54) INK-JET PRINT HEAD ASSEMBLIES WITH A SPACER SURROUNDING AN INK FILL PORT AND METHOD OF MANUFACTURING

(71) Applicants: Hewlett-Packard Development Company, L.P., Houston, TX (US); Aidan O Reilly, Leixlip (IE); Tommy OConnor, Leixlip (IE); John Oliver, Leixlip (IE); David Kelly, Leixlip (IE); Stephen Byrne, Leixlip (IE)

(72) Inventors: Aidan O'Reilly, Leixlip (IE); Tommy O'Connor, Leixlip (IE); John Oliver, Leixlip (IE); David Kelly, Leixlip (IE); Stephen Byrne, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/311,605

(22) PCT Filed: Jul. 1, 2016

(86) PCT No.: PCT/EP2016/001125
§ 371 (c)(1),
(2) Date: Dec. 19, 2018

(87) PCT Pub. No.: WO2018/001443
PCT Pub. Date: Jan. 4, 2018

(65) Prior Publication Data
US 2019/0329561 A1 Oct. 31, 2019

(51) Int. Cl.
*B41J 2/175* (2006.01)

(52) U.S. Cl.
CPC ..... *B41J 2/17513* (2013.01); *B41J 2/17553* (2013.01); *B41J 2/17559* (2013.01); *B41J 2/17566* (2013.01)

(58) Field of Classification Search
CPC ..... B41J 2/17513; B41J 2/17553; B41J 2/17559; B41J 2/17566
See application file for complete search history.

(56) References Cited

U.S. PATENT DOCUMENTS 5,619,239 A * 4/1997 Kotaki ..... B41J 2/1752 347/86
6,145,974 A 11/2000 Shinada et al.
(Continued)

OTHER PUBLICATIONS

Flowblog, "Standoff Height: How Close Should You Be?," May 8, 2015, 3 pages, https://flowwaterjetblog.com/2015/05/08/standoff-height-how-close-should-you-be/.

*Primary Examiner* — Huan H Tran
(74) *Attorney, Agent, or Firm* — International IP Law Group, PPLC

(57) ABSTRACT

A print head assembly for an ink-jet printer operable with a continuous ink supply system is disclosed, with an ink compartment, a foam insert, an ink fill port, and a spacer. The ink fill port receives ink fed from an external supply and to be printed by the print head assembly. The ink compartment stores the ink to be printed. The foam insert is in the ink compartment and takes up the ink to be stored. The spacer extends into the ink compartment, provides for the formation of a clearance between the foam insert and the ink fill port and surrounds the ink fill port either completely or with one or more gaps having a gap width. The gap width of none of the gaps presents an aperture angle of more than 25% of 36° with respect to a center of the ink fill port.

13 Claims, 6 Drawing Sheets

(56) References Cited

U.S. PATENT DOCUMENTS

| | | | | |
|---|---|---|---|---|
| 6,161,927 | A | 12/2000 | Long et al. | |
| 6,220,701 | B1 * | 4/2001 | Umemura | B41J 2/17513 347/86 |
| 6,247,803 | B1 | 6/2001 | Kanaya et al. | |
| 6,260,961 | B1 | 7/2001 | Seu et al. | |
| 6,649,987 | B1 | 11/2003 | Staker et al. | |
| 6,899,417 | B1 * | 5/2005 | Shinada | B41J 2/17513 347/86 |
| 7,354,137 | B2 | 4/2008 | Drummond et al. | |
| 8,191,356 | B2 | 6/2012 | Pollitt et al. | |
| 2003/0117468 | A1 * | 6/2003 | Inoue | B41J 2/17553 347/86 |
| 2005/0168549 | A1 * | 8/2005 | Shinada | B41J 2/17513 347/86 |
| 2006/0238584 | A1 * | 10/2006 | Putman | B41J 2/17513 347/86 |
| 2006/0262170 | A1 * | 11/2006 | Putman | B41J 2/17513 347/86 |
| 2012/0110931 | A1 | 5/2012 | Eiffert et al. | |
| 2015/0206862 | A1 | 7/2015 | Opiniano | |

* cited by examiner

INK-JET PRINT HEAD ASSEMBLIES WITH A SPACER SURROUNDING AN INK FILL PORT AND METHOD OF MANUFACTURING

CROSS-REFERENCE TO RELATED APPLICATION

Pursuant to 35 U.S.C. § 371, this application is a United States National Stage Application of International Patent Application No. PCT/EP2016/001125, filed on Jul. 1, 2016, the contents of which are incorporated by reference as if set forth in their entirety herein.

BACKGROUND

Continuous ink supply systems are used in some ink-jet printers to ensure a steady and or uninterrupted availability of ink for printing jobs. A reservoir, such as an external ink supply, may contain a volume of ink, which is generally larger than the volume of ink an ink compartment of the print head assembly and can be supplied to the print head assembly and the ink compartment. Thereby, the risk of running out of ink may be reduced. The printing capacity may be increased. Moreover, a steady level of ink in the print head may facilitate reproducible print quality.

The ink fed from the external supply for temporary storage in the print head before printing may be filled into the ink compartment of the print head assembly via an ink fill port. The ink may be stored in the ink comportment of the print head assembly in a foam insert, which takes up the ink during storage and releases the ink to be discharged in a printing process by the print head assembly.

BRIEF DESCRIPTION OF THE DRAWINGS

Various examples will be described below by referring to the following Figures.

DETAILED DESCRIPTION

Figure 1:
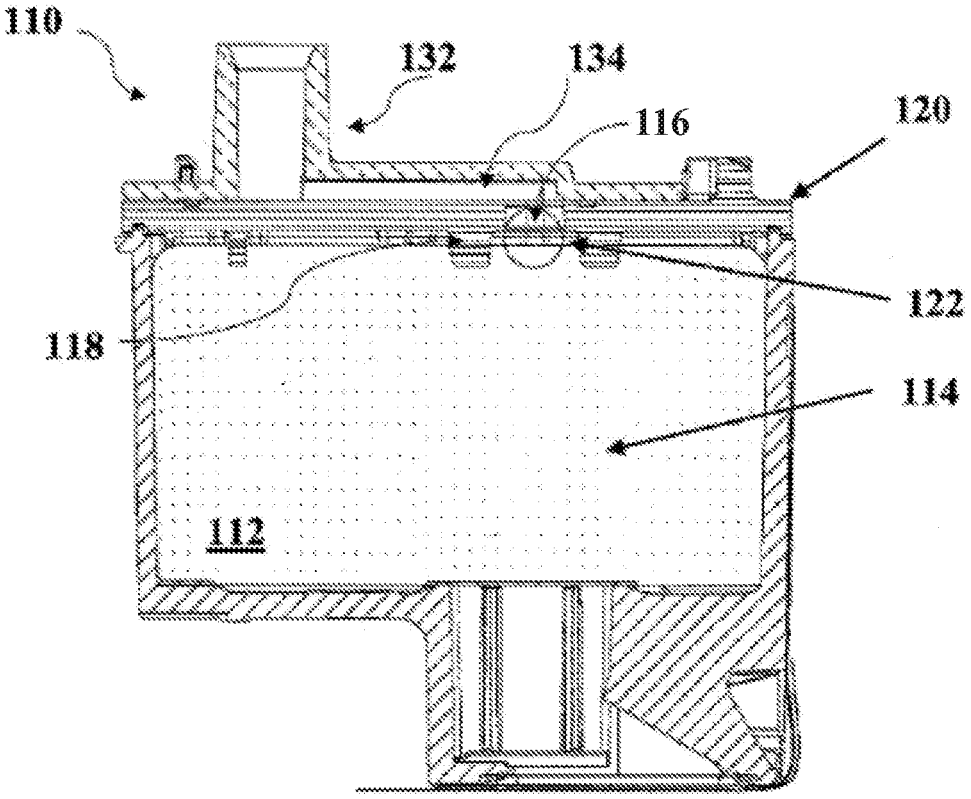
FIG. 1 shows a cross-section of a print head assembly for an ink-jet printer operable with a continuous ink supply system.

FIG. 1 schematically illustrates a print head assembly 110 for an ink-jet printer operable with a continuous ink supply system according to one example.

However, before proceeding further with a detailed description of FIG. 1, further aspects will be discussed.

An aspect provides a print head assembly for an ink-jet printer operable with a continuous ink supply system. The print head assembly comprises an ink compartment, a foam insert, an ink fill port, and a spacer. The ink fill port is for receiving ink fed from an external supply and to be printed by the print head assembly. The ink compartment is for storing the ink to be printed. The foam insert is in the ink compartment and for taking up the ink to be stored. The spacer extends into the ink compartment, provides for the formation of a clearance between the foam insert and the ink fill port surrounds the ink fill port either completely or with one or more gaps having a gap width, wherein the gap width of none of the gaps presents an aperture angle of more than 25% of 360° with respect to a center of the ink fill port.

In some examples, the ink compartment may be an essentially hollow space in the print head assembly adapted to keep a certain volume of ink available in vicinity to the print head such that the print head can draw from said volume of ink to fulfill active print jobs.

In some examples, the foam insert may be a capillary media adapted to of take up the ink to be stored. For instance, sponge-like materials may be used, such as a polyurethane sponge and a fibrous sponge.

In some examples, the ink fill port may be an opening in the print head assembly for (direct or indirect) coupling to an external supply of ink and to receive ink fed from said supply. For instance, an ink fill port may be used during manufacturing of a print head assembly to receive the initial fill of ink from an external supply. Such ink fill ports may be referred to as "initial fill ports".

Additionally or alternatively, an ink fill port may be used during operation of a print head assembly in an ink-jet printer with a continuous ink supply system to continuously, quasi-continuously, regularly or at least repeatedly receive ink from an external supply to maintain a given level of ink in the ink compartment. The "continuous" supply of ink may occur with or without interruptions. For instance, during phases of high printing volume, ink may be supplied in larger quantities than during phases of low printing volume. The quantity of ink to be supplied may be controlled by a variety of variables, such as pressure. A pressure difference between the external supply and the ink compartment of the print head assembly may drive ink from the external supply into the ink compartment. In such cases, an essentially constant level of ink in the ink compartment may be envisioned. In some examples, the continuous ink supply may be actively driven, such as by a pump.

In some examples, the spacer may be a distance piece for the ink fill port, adapted to physically contact the foam and thereby form a clearance between the foam and the ink fill port. In general, the spacer may be physically and rigidly coupled to the ink fill port in order to provide for a durable protection from influences such as from contact with the foam insert.

In some examples, the clearance between the foam insert and the ink fill port may be a space which is capable of comprising a volume of air. The volume of air may change, e.g. in shape or size, depending on ambient conditions. For instance, a change in temperature or in pressure may lead to a change in size of the volume of air. The clearance formed between the foam insert and the ink fill port by the spacer may be adapted to comprise this volume of air for at least a certain range in ambient conditions.

In some examples, the spacer may surround the ink fill port completely. In particular, it may be continuous and not comprise any gaps. In some examples, the spacer may surround the ink fill port with one, two or more gaps having a gap width. In general, no gap has a gap width, which presents an aperture angle of more than 25% of 360° with respect to a center of the ink fill port. Examples of gap width include aperture angles of 1%, 5%, 10%, 20% or 25% of 360° with respect to a center of the ink fill port. In cases of multiple gaps, the gaps may or may not have a same gap width.

Gaps with an aperture angle of no more than 25% of 360° may provide for the formation of air paths between the ink fill port and an area surrounding the spacer above the foam insert, while hindering contact between the foam insert and the ink fill port. This may prevent the gaps from being sealed by a portion of the foam insert protruding into the gap, whereby an air path between the ink fill port and an area surrounding the spacer above the foam insert may be sealed. Additionally or alternatively, this may prevent a foam insert from contacting and potentially sealing the ink fill port.

In some examples, the spacer may be discontinuous to provide for at least one air path between the ink fill port and an area surrounding the spacer above the foam insert.

In some examples, the discontinuity may be due to gaps or discrepancies. In particular, the spacer may comprises multiple spacer members, which are separated by discontinuities or gaps. In such cases, the gaps may provide for the spacer being discontinuous and for formation of an air path.

In some examples, the air path may be an area, which does not preclude fluid communication, in particular gas communication, between two ends of said air path. However, the size, shape or form of an "air path" is not restricted. In particular, an air path may or may not be elongate in shape.

In some examples, the area surrounding the spacer above the foam insert may be an area or space located between the foam insert and the upper boundary of the print head assembly, while the spacer and the area adjacent to the ink fill port and surrounded by the spacer may be excluded from such area or space. Such area may in some cases, at least partially form part of the ink compartment.

Here, if not otherwise specified, terms such as "above", "below", "upward", "downward" may refer to the physical orientation when used in a printer, in particular in view of acting gravity forces. These orientations may or may not coincide with the views illustrated in the drawings.

In some examples, the ink fill port and the spacer may be located essentially above the ink compartment and the foam insert. In such cases, the ink to be printed may be discharged in an essentially downward direction from the ink compartment.

In some examples, the print head assembly may comprise a lid, which comprises the ink fill port and the spacer. The lid may be an upper closure of the print head assembly. In particular, the lid may cap and seal the ink compartment of the print head assembly. In cases of a pressure-driven continuous ink supply system, the lid mounted on the print head assembly may reliably seal the print head assembly to withstand and uphold the pressure difference driving the continuous ink supply.

In some examples, the print head assembly may comprise an ink supply channel for feeding ink from the external ink supply to the ink fill port.

In some examples, the print head assembly may comprise at least one of a manifold and a tubing, for connection to the external ink supply. A manifold may be equipped with connectors for facilitated connection, removal and replacement of the external ink supply. In some examples, the manifold may be equipped for connection, removal and replacement of the external ink supply during operation. In such cases, the manifold may for instance comprise a sealing septum to uphold the pressure in the ink compartment despite removal of the external supply.

In some examples, the print head assembly may comprise the external ink supply.

In some examples, the spacer may be a standoff. The standoff may be a spacer, which is formed of the same material as the material surrounding the opening of the ink fill port. For instance, in cases of the print head assembly comprising a lid, and an ink fill port formed in the lid, the material of both the lid and the standoff may comprise polyethylene terephthalate (PET). Additionally or alternatively, the material may comprises glass gibers, e.g. for increased rigidity. In some examples, the material may be glass-filled PET, such as PET with 15% glass fibers.

In cases of the print head assembly comprising a lid with a standoff, the lid and the standoff may be produced by injection molding.

In general, the properties (such as dimensions, materials, rigidity) of the spacer may be chosen dependent on the materials used. For instance, dependent on an elasticity of a foam insert to be used, the height and/or the aspect ratio of the spacer may be chosen. As mentioned above, the foam insert may for instance be a polyurethane sponge. The standoff may be at least 2.2 mm in height. Additionally or alternatively, the standoff may have an aspect ratio (height: width) of about 1:3.

In some examples, the print head assembly may be movable and may be for use in a swath-type printer. In a swath-type printer, the print head assembly may be movable with respect to the substrate to be printed. In such cases, printing quality or reproducibility may be influenced by the mass and inertia of the print head assembly. In continuous ink supply systems, in cases where the external supply of ink is not moved along with the print head assembly, the mass and inertia of the print head assembly may be reduced as compared to a print head assembly containing a comparable volume of ink.

Another aspect provides a method of manufacturing a print head assembly for an ink-jet printer operable with a continuous ink supply system. The method may comprise building an ink compartment, filling a foam insert into the ink compartment, building an ink fill port, and building a spacer. The ink fill port may be built for receiving ink fed from an external supply and to be ink-jet printed by the print head assembly. The ink compartment may be built for storing the ink to be printed. The foam insert may be filled into the ink compartment for taking up the ink to be stored. The spacer may be built to extend into the ink compartment, to provide for the formation of a clearance between the foam insert and the ink fill port and to surround the ink fill port either completely or with one or more gaps having a gap width, wherein the gap width of none of the gaps presents an aperture angle of more than 25% of 360° with respect to a center of the ink fill port.

In some examples, the spacer may be built to be discontinuous in order to provide for at least one air path between the ink fill port and an area surrounding the spacer.

In some examples, the method may comprise building a lid for the print head assembly, wherein the ink fill port and the least one spacer are built at the lid. In such cases, the building of the lid with the ink fill port and the spacer may be carried out by injection molding. The lid may be mounted onto the print head assembly by one of a variety of processes, such as by ultrasonic welding. Ultrasonic welding may ensure a tight sealing of the print head assembly, e.g. to uphold the pressure inside the ink compartment in the case of pressure-driven continuous ink supply systems.

Returning to FIG. 1, the print head assembly 110 according to FIG. 1 has an ink compartment 112, a foam insert 114, an ink fill port 116 and a spacer 118.

In addition, the print head assembly 110 has a manifold 132 for connection to an external ink supply (not shown) and an ink supply channel 134 for feeding ink from the external ink supply to the ink fill port 116.

The ink fill port 116 receives ink fed from the external supply via the manifold 132 and the ink supply channel 134. The ink is to be printed by the print head assembly 110.

The ink compartment 112 stores the ink to be printed. The foam insert 114 is in the ink compartment 112 and takes up the ink to be stored.

The spacer 118 extends into the ink compartment 112, provides for the formation of a clearance 122 between the foam insert 114 and the ink fill port 116 and surrounds the ink fill port 116 with a gap having a gap width, which does not present an aperture angle of more than 25% of 360° with respect to a center of the ink fill port.

The ink fill port 116 and spacer 118 are part of a lid 120 of the print head assembly. They are located essentially above the ink compartment and the foam insert.

The ink to be printed may be discharged from the foam insert and form the ink compartment. The ink to be printed is received by a print head (not shown), which may be located in the lower portion of the print head assembly 110. The print head contains nozzle(s) to emit or eject the ink onto a substrate to be printed on. Ink discharge from the foam insert, e.g. by ejection through print head nozzles, gives rise to ink refilling from the external supply through the ink fill port to uphold the previous level of ink in the ink compartment. In particular, ink discharge results in a drop in pressure in the ink compartment. In a pressure-driven continuous ink supply system, the drop in pressure may lead to novel ink to be drawn into the ink compartment.

Figure 2:
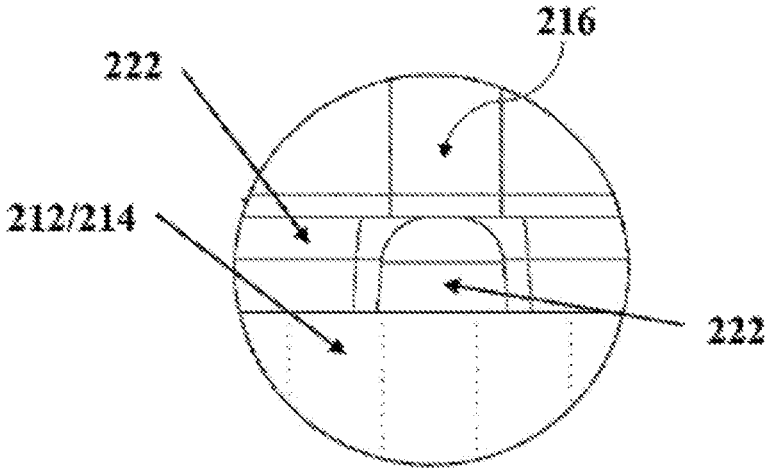
FIG. 2 shows an expanded detail of the cross-section of the print head assembly of FIG. 1.

FIG. 2 schematically illustrates an enlarged detail of the print head assembly 110 according to the example of FIG. 1, as indicated by a circle at ink fill port 116 of FIG. 1.

In particular, FIG. 2 shows the portion of ink fill port 216, which opens into ink compartment 212 filled with a foam insert 214.

The ink fill port 216 is surrounded by a spacer 218 with a gap having a gap width, which does not present an aperture angle of more than 25% of 360° with respect to a center of the ink fill port 216. The spacer 218 is essentially circular when viewed from below. As a result, the cross-section shown in FIG. 2 shows spacer 218 as two elements, extending into ink compartment 212. Spacer 218 is in contact with foam insert 214 and acts as a distance piece pressing the insert down into the ink compartment and hindering contact between the foam insert 214 and ink fill port 216. The lack of contact between the foam insert 214 and the ink fill port 216 allows for the formation of a clearance 222 between the foam insert 214 and the ink fill port 216. Ink taken up by the foam insert 214 is hindered from contacting and potentially sealing the underside of ink fill port 216. In the case of contact between the foam insert 214 and the ink fill port 216, ink from the foam insert 214 may migrate upwards through ink fill port 216. Such migration is suppressed by avoiding contact between the foam insert 214 and the ink fill port 216 and in particular by formation of the clearance 222.

The clearance 222 may change in size upon changing ambient conditions. For instance, a decrease in ambient temperature may give rise to a decrease in size of the clearance 222 by isobaric compression of the gas contained therein. In case of a relatively small spacer 218 (or complete lack thereof), the clearance 222 (if existent at all) may not be sufficiently proportioned to hinder contact between ink fill port 216 and ink from the foam insert 214 over a range of ambient temperatures common for ink-jet printer uses. Similarly, upon an ambient temperature increase, a volume of air in the clearance 222 may expand. Based on its location underneath the ink fill port, the air may expand through the ink fill port into the tubing of channel above. In the absence of a way of liberating expanding gas, ink drool may occur.

Figure 3:
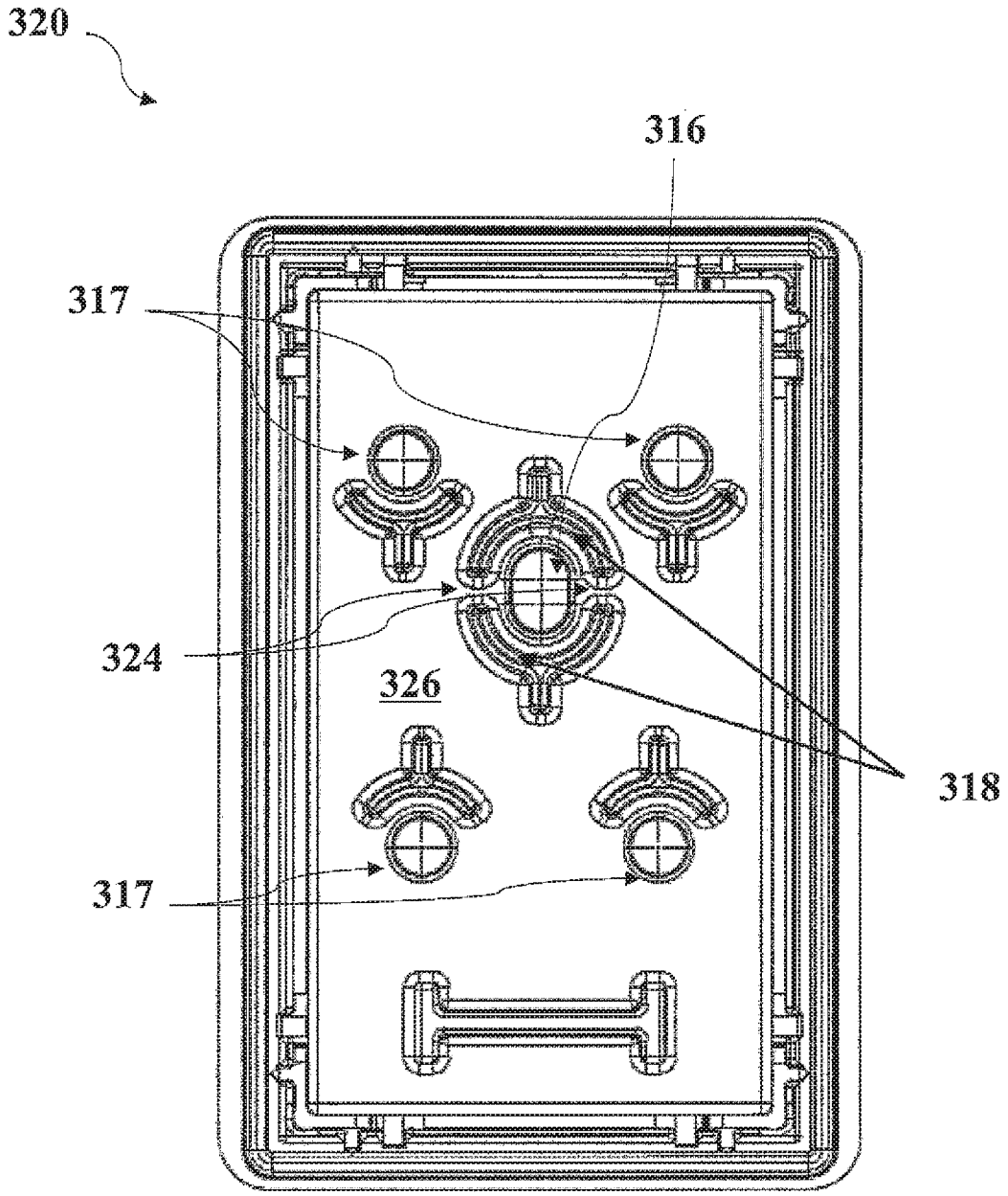
FIG. 3 shows a bottom view of a lid of a print head assembly for an ink-jet printer operable with a continuous ink supply system.

FIG. 3 schematically illustrates a lid 320 of a print head assembly for an ink-jet printer operable with a continuous ink supply system according to one example. The lid 320 is depicted in bottom view in FIG. 3.

The lid 320 has an ink fill port 316 for continuously receiving ink fed from an external supply (not shown). Further, lid 320 has four ports 317 for an initial filling of an ink compartment of a print head assembly (not shown) onto which the lid may be mounted. Ports 317 are not for continuously receiving ink. Ink fill port 316 is surrounded by a spacer 318 with two gaps having a gap width, wherein the gap width of none of the gaps presents an aperture angle of more than 25% of 360° with respect to a center of the ink fill port.

Ports 317 are partially surrounded with spacers. In particular, the spacers surrounding ports 317 are essentially quadrant-shaped with additional straight portions for increased stability. In the case of "initial ink fill" ports 317, a contact between a foam insert and ink fill port opening may in general be considered as not as critical as in the case of a "continuous" ink fill port, e.g. ink fill port 316. Each one of ink fill port 317 is surrounded by a spacer with a gap, whose gap width presents an aperture angle of 75% of 360° with respect to the center of the respective one of ports 317. A sealing of one or more of ports 317 after initial filling can be considered to not influence the functioning of the print head, since the ports 317 have served to initially fill the ink compartment.

In particular, the "continuous" ink fill port 316 (for continuously receiving ink) shall be protected from sealing or other detrimental influences (such as those mentioned above) by the ink contained in the foam insert or by air trapped between the foam insert and the lid.

Spacer 318 of the lid 320 as shown in FIG. 3 is of a generally circular shape (in bottom view as depicted) with two straight appendices extending radially outwards (at 12 o'clock and 6 o'clock positions of the circumference, when viewed as depicted in FIG. 3) for increased stability and with two discontinuities or gaps (at 3 o'clock and 9 o'clock positions in FIG. 3). Based on the two discontinuities 324, the spacer is considered to comprise two symmetrical spacer members.

The discontinuities 324 may also be referred to as gaps and provide for the formation of one or more air paths between the ink fill port 316 and an area 326 surrounding the spacer 316 above the foam insert. The air path serves as a way of fluid communication between the ink fill port 316 and the area 326. In particular, any air bubbles trapped in area 326 above the foam insert may escape through one of air paths provided by discontinuities 324 into the ink fill port and migrate upwards from the port (e.g. into a manifold or tubing). Additionally or alternatively, said air paths provide for a smooth filling of ink through ink fill port 316. Each of the two gaps has a gap width presenting an aperture angle of about 5% of 360° with respect to a center of the ink fill port. In some examples, the gap width of each gap may be smaller, such as presenting an aperture angle of about 1%, or greater, such as presenting an aperture angle of about 10% or 20% of 360°. Gap widths presenting aperture angles of no more than 25% of 360° may be capable of providing for the formation of air paths.

Figures 4A, 4B:
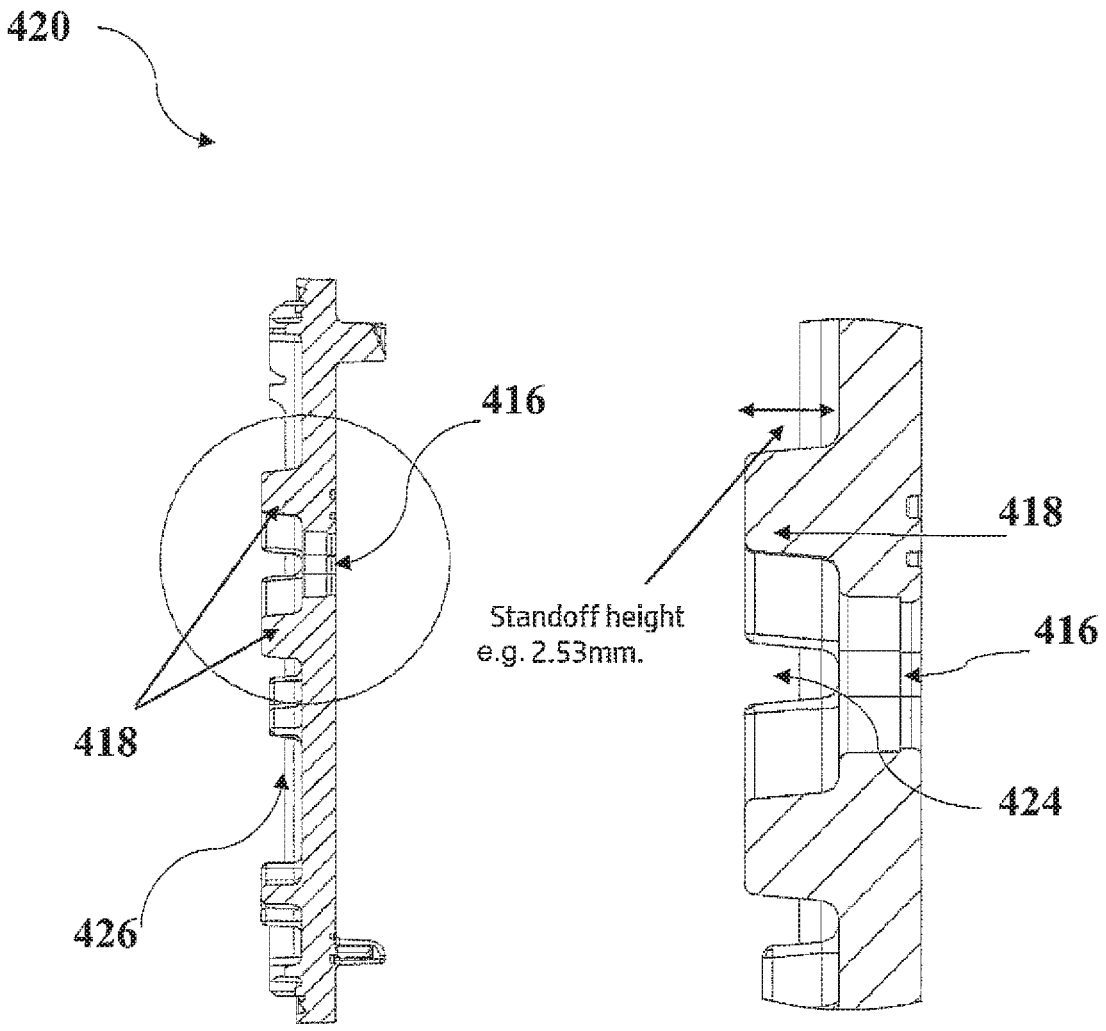
FIG. 4A shows a cross-section of a lid of a print head assembly for an ink-jet printer operable with a continuous ink supply system.
FIG. 4B shows an expanded detail of the cross-section of the lid of FIG. 4A.

FIG. 4A shows a cross-section of a lid 420 of a print head assembly for an ink-jet printer operable with a continuous ink supply system. FIG. 4B shows an expanded detail of the cross-section of the lid of FIG. 4A. Lid 420 of FIGS. 4A and 4B may essentially correspond to lid 320 according to the example of FIG. 3, wherein the cross-section is taken along the axis of symmetry of lid 320 from top to bottom of FIG. 3.

In FIGS. 4A and 4B, lid 420 comprises an ink fill port has an ink fill port 416 for continuously receiving ink fed from an external supply (not shown). Ink fill port 416 is surrounded with a spacer 418 with one or more gaps having a gap width, wherein the gap width of none of the gaps presents an aperture angle of more than 25% of 360° with respect to a center of the ink fill port 416. The spacer is formed of the same material as lid 420 and may be referred to as standoff 418. The spacer 418 has a height of 2.53 mm and an aspect ratio (height:width) of about 1:3, wherein the diameter of the essentially circular spacer 418 is taken as its width.

A discontinuity 424 of spacer 418 is provided in form of a gap in the circumference of spacer 418. The gap has a gap width presenting an aperture angle of about 10% of 360° with respect to the center of the ink fill port. The discontinuity 424 provides for the formation of at least one air path between the ink fill port 416 and an area 426 surrounding the spacer 416 above an foam insert of an ink compartment of a print head assembly onto which lid 420 may be mounted.

Figure 5A:
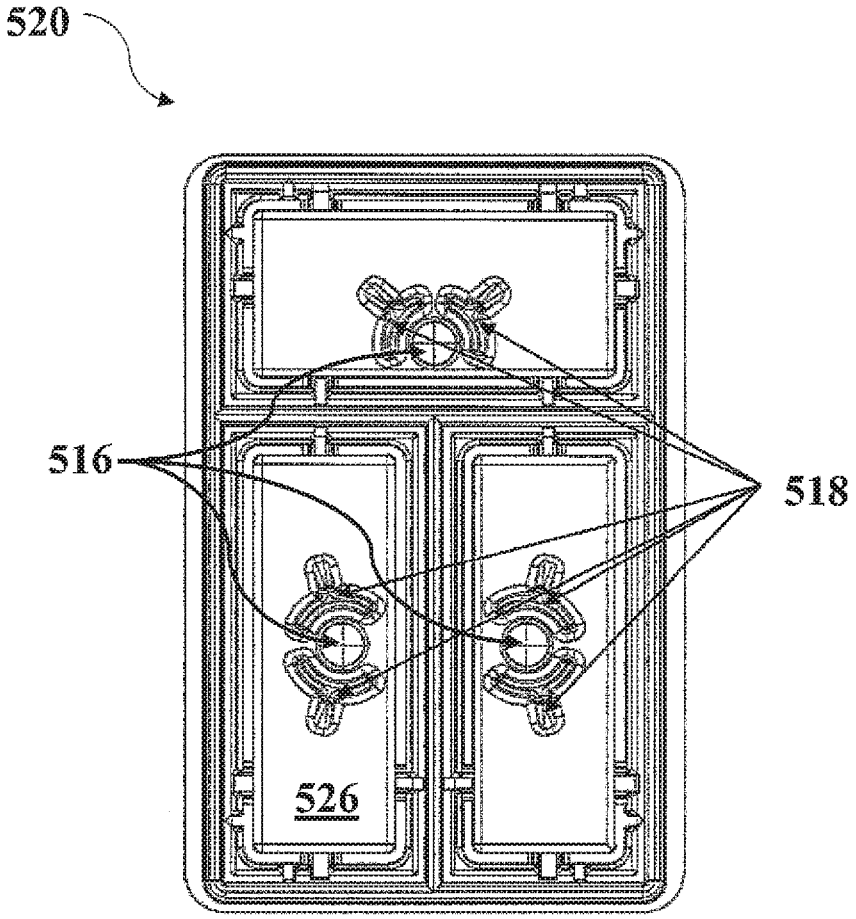
FIG. 5A shows a bottom view of a lid of a print head assembly for an ink-jet printer operable with a continuous ink supply system.

FIG. 5A shows a bottom view of a lid 520 of a print head assembly for an ink-jet printer operable with a continuous ink supply system according to another example. Lid 520 has three ink fill ports 518. In particular, each ink fill port may serve to fill ink of another color into a respective one of three ink compartments (not shown) of a print head assembly onto which the lid 520 may be mounted. For instance, each one of the three ink fill ports 518 may serve fill cyan, yellow, and magenta (CYM) color ink, respectively.

Figure 5B:
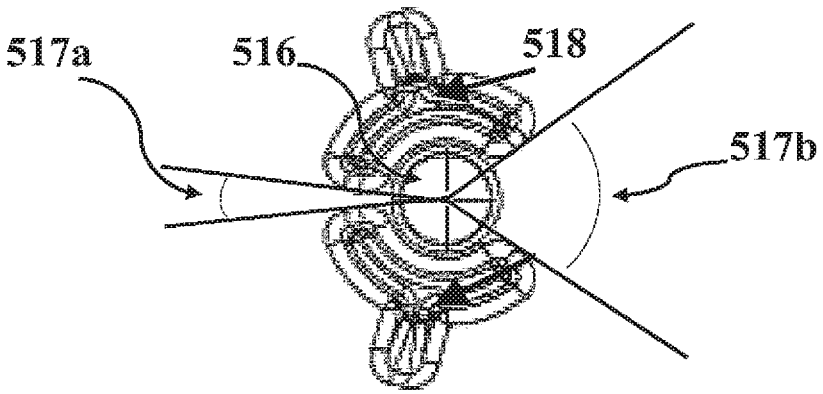
FIG. 5B shows an expanded detail of the bottom view of the lid of FIG. 5A.

Each one of ink fill ports 518 is partially surrounded by a respective spacer 516 with two gaps having a gap width, wherein the gap width of none of the gaps presents an aperture angle of more than 25% of 360° with respect to a center of the ink fill port. Each one of spacers 516 has a partially arcuate form and is discontinuous with two gaps providing for an air path between the respective ink fill port 518 and an area 526 surrounding, or at least adjacent to, the respective spacer 516 above a foam insert in a respective one of the three ink compartments. One of the ink fill ports 518 with spacer 516 according to FIG. 5A is shown in expanded view in FIG. 5B. A first gap of spacer 516 has gap width presenting an aperture angle 517*a* of about 5% of 360° with respect to the center of the ink fill port 518. A second gap of spacer 516 has gap width presenting an aperture angle 517*b* of about 25% of 360° with respect to the center of the ink fill port 518. Neither the first nor the second gap has a gap width presenting an aperture angle of more than 25% of 360° with respect to the center of the ink fill port 518.

Figure 6:
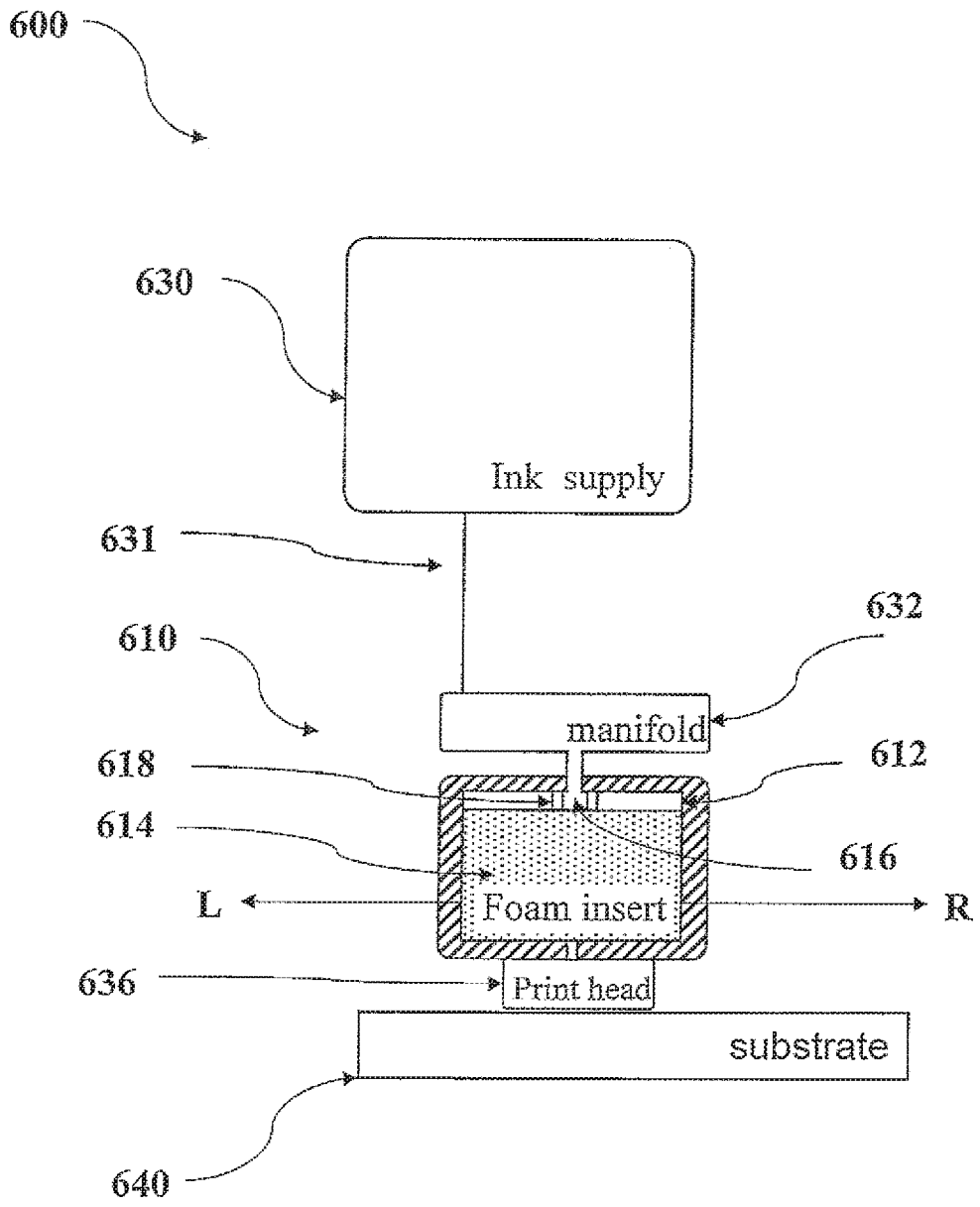
FIG. 6 schematically shows an ink-jet printer with a continuous ink supply system and a print head assembly.

FIG. 6 schematically shows an ink-jet printer 600 with a print head assembly 610 according to one example The printer 600 is equipped with an external ink supply 630 and the print head assembly 610.

The ink supply 630 is connected via tubing 631 to the print head assembly 610. The print head assembly comprises a manifold 632 for connection to the tubing 631. The manifold 632 is further connected to an ink fill port 616 of the print head assembly 610 feeds ink from the external ink supply 630 via ink fill port 616 into an ink compartment 612 of print head assembly 610. The ink fill port 616 is surrounded by a spacer 618 completely, i.e. without gaps. The spacer extends into the ink compartment 618. The ink compartment 612 is partially filled with a foam insert 614 for taking up the ink fed in via the ink fill port 616 and to be printed.

The foam insert 614 is in contact with spacer 618. The spacer provides for a clearance between the foam insert and the ink fill port. In the depicted case, the foam insert is not deformed or compressed by the spacer 618. In some examples, the foam insert may be deformed or compressed by the spacer 618.

The print head assembly also has a print head 636 which receives ink discharged from the foam insert 614 and form the ink compartment 612. The print head 636 is located in the lower portion of the print head assembly 610. The print head contains nozzles to emit the ink onto a substrate 640 to be printed on, such as a piece of paper or a three-dimensional printing substrate.

The printer 600 is a swath-type printer, wherein the print head assembly 610 is movable relative to the substrate 640 and to other components of the printer 600, as indicated by arrows R and L in FIG. 6. In this case, the external ink supply 630 is stationary with respect to the printer 600. Thus, the print head assembly 610 may be movable with respect to the ink supply 630. The tubing 631 and its properties may be chosen to ensure repeated and unobstructed mobility of the print head assembly. The set of external ink supply 630, the print head assembly 610 as well as the tubing 631 linking both can be referred to as a continuous ink supply system.

Figure 7:
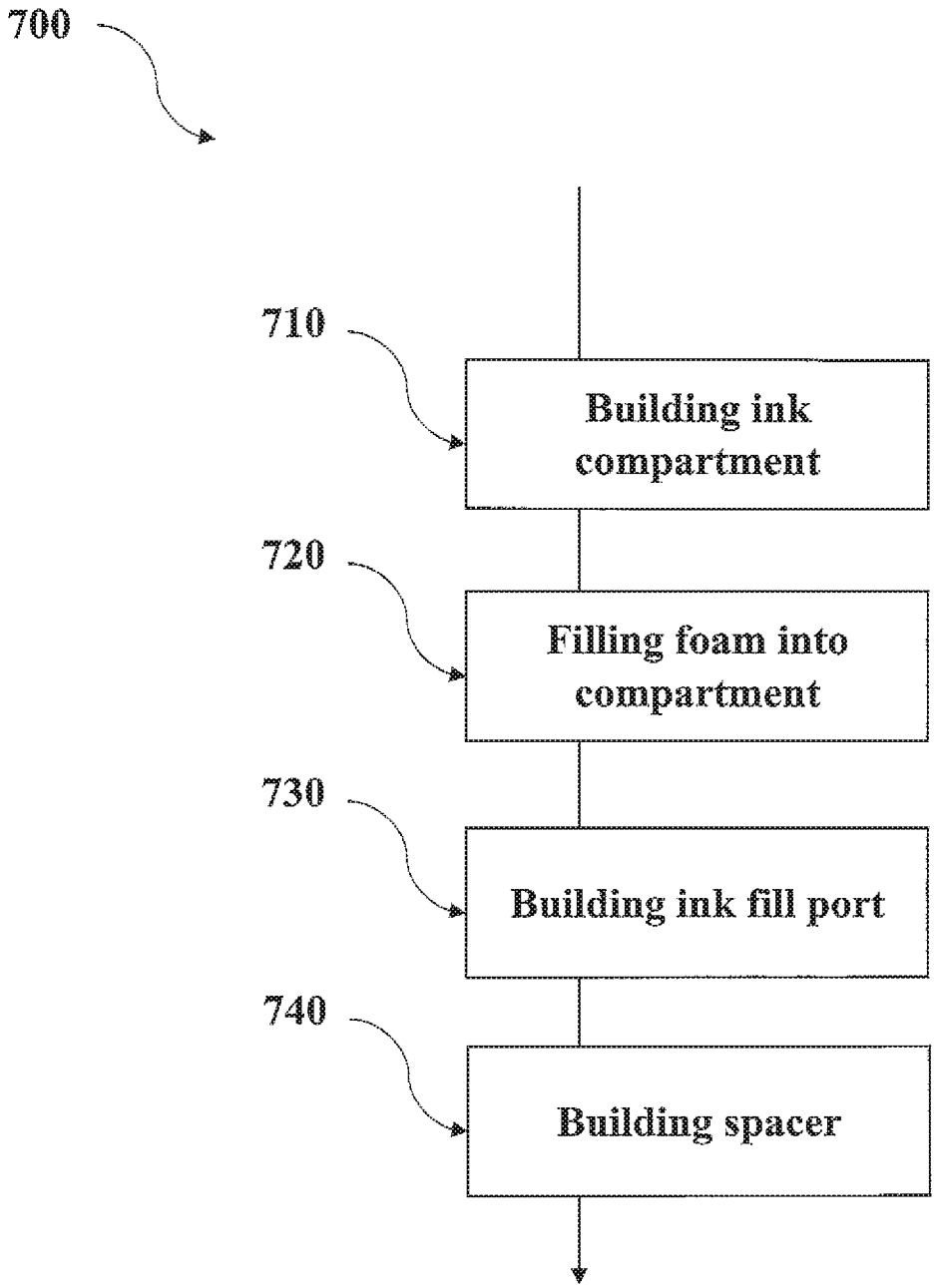
FIG. 7 schematically shows flow diagram of a method of manufacturing a print head assembly.

FIG. 7 schematically shows flow diagram of a method 700 of manufacturing a print head assembly for an ink-jet printer operable with a continuous ink supply system according to one example. The method comprises building an ink compartment (710), filling a foam insert into the ink compartment (720), building an ink fill port (730), and building a spacer (740).

The ink compartment is built for storing the ink to be printed. The foam insert is filled in the ink compartment for taking up the ink to be stored. The ink fill port is built for receiving ink fed from an external supply and to be ink-jet printed by the print head assembly. The spacer is built to extend into the ink compartment to provide for the formation of a clearance between the foam insert and the ink fill port and to surround the ink fill port either completely or with one or more gaps having a gap width, wherein the gap width of none of the gaps presents an aperture angle of more than 25% of 360° with respect to a center of the ink fill port.

The invention claimed is:

1. A print head assembly for an ink-jet printer operable with a continuous ink supply system, the print head assembly comprising:

an ink compartment to store ink to be printed;

a foam insert in the ink compartment to take up the ink to be stored;

an ink fill port to receive the ink fed from an external ink supply and to be printed by the print head assembly;

an ink supply channel for feeding ink from the external ink supply to the ink fill port; and a spacer extending into the ink compartment to provide for a formation of a clearance between the foam insert and the ink fill port and surrounding the ink fill port either completely or with one or more gaps having a gap width, wherein the gap width of none of the gaps presents an aperture angle of more than 25% of 360° with respect to a center of the ink fill port.

2. The print head assembly according to claim 1, wherein the spacer is discontinuous to provide for at least one air path between the ink fill port and an area surrounding the spacer above the foam insert.

3. The print head assembly according to claim 1, wherein the ink fill port and the spacer are located essentially above the ink compartment and the foam insert, and wherein the ink to be printed is to be discharged in an essentially downward direction from the ink compartment.

4. The print head assembly according to claim 1, the print head assembly further comprising a lid comprising the ink fill port and the spacer.

5. The print head assembly according to claim 1, comprising at least one of a manifold and a tubing, for connection to the external ink supply.

6. The print head assembly according to claim 1, comprising the external ink supply.

7. The print head assembly according to claim 1, wherein the spacer is a standoff.

8. The print head assembly according to claim 7, wherein the standoff is at least 2.2 millimeters (mm) in height.

9. The print head assembly according to claim 7, wherein the standoff has an aspect ratio of height to width of about 1:3.

10. The print head assembly according to claim 1, wherein the print head assembly is movable and is for use in a swath-type printer.

11. A method of manufacturing a print head assembly for an ink-jet printer operable with a continuous ink supply system, comprising:

building an ink compartment for storing the ink to be printed;

filling a foam insert into the ink compartment, the foam insert for taking up the ink to be stored;

building an ink fill port for receiving ink fed from an external supply and to be ink-jet printed by the print head assembly; and building a spacer that extends into the ink compartment and provides for a formation of a clearance between the foam insert and the ink fill port, and surrounds the ink fill port either completely or with one or more gaps having a gap width, wherein the gap width of none of the gaps presents an aperture angle of more than 25% of 360° with respect to a center of the ink fill port, wherein the spacer is discontinuous to provide for at least one air path between the ink fill port and an area surrounding the spacer.

12. The method according to claim 11, comprising building a lid for the print head assembly, wherein the ink fill port and the spacer are built at the lid.

13. The method according to claim 12, wherein the building of the lid with the ink fill port and the spacer is carried out by injection molding.

* * * * *